United States Patent [19]

Transport

[11] 4,319,418

[45] Mar. 16, 1982

[54] COLLAPSIBLE ORNAMENTAL SOLIDS

[75] Inventor: Felix Transport, 98 Riverside Dr., New York, N.Y. 10024

[73] Assignee: Felix Transport, New York, N.Y.

[21] Appl. No.: 172,987

[22] Filed: Jul. 28, 1980

[51] Int. Cl.[3] ..... G09F 1/00

[52] U.S. Cl. ..... 40/124.1; 40/537; 40/160; 46/34

[58] Field of Search ..... 40/1, 124.1, 539; 46/34

[56] References Cited

U.S. PATENT DOCUMENTS

| | | | |
|---|---|---|---|
| 2,546,878 | 3/1951 | Townley | 40/539 |
| 2,935,238 | 5/1960 | Koehler | 40/124.1 |
| 3,267,597 | 8/1966 | Jannes | 40/124.1 |

FOREIGN PATENT DOCUMENTS

| | | | |
|---|---|---|---|
| 467854 | 6/1937 | United Kingdom | 40/124.1 |

*Primary Examiner*—Gene Mancene
*Assistant Examiner*—Wenceslao J. Contreras
*Attorney, Agent, or Firm*—James David Jacobs

[57] ABSTRACT

A versatile collapsible ornamental solid having a fully enclosed hollow interior is disclosed. The collapsible ornamental solid is cut from a single sheet of paper or similar material, folded and bonded, and encircled by an elastic band. Additionally, other collapsible ornamental solids having hollow interiors, generally in the shape of spires, are disclosed. These can be bonded to the basic collapsible ornamental solid and the combination collapsed so as to be substantially flat. The collapsible ornamental solids remain in the collapsed state as long as restraining pressure is applied substantially perpendicular to the faces of the collapsed ornamental solids, but automatically deploy by reason of the encircling elastic band when such restraining pressure is removed.

17 Claims, 17 Drawing Figures

COLLAPSIBLE ORNAMENTAL SOLIDS

BACKGROUND OF THE INVENTION

1. Field of the Invention

This invention relates generally to paper construction, and is more particularly directed to an ornamental solid suitable for display by itself or as a receptacle for decorative or photographic works.

2. Prior Art

The prior art contains automatically deployed solid constructions. U.S. Pat. No. 822,841, issued to W. F. Hill, discloses a collapsible carton. This carton is made from a single sheet which is folded. When the pressure confining the folded carton is released, the carton assumes its expanded or deployed position. The carton is forced into its deployed position by an elastic band which extends from the midpoint of the intersection of two sides diagonally across the interior of the carton to the midpoint of the intersection of the other two sides.

Another automatic deploying solid construction is shown in U.S. Pat. No. 2,883,074. Like the construction above this also uses an elastic band, an ordinary commercial rubber band, to provide the force to automatically "pop-up" the construction. Also, like the above construction this construction is made from a single piece of sheet material. This construction, in addition to the basic cubic shape, includes means to hinge ornamental designs, such as a Christmas tree, to one edge of the construction.

All of the above constructions suffer from a few common disadvantages. First, they do not provide for an unusual ornamental shape. Rather, they comprise merely rectangular shapes.

Moreover, none of the constructions provide for a positive closure of the enclosed solid. That is, although flaps are provided that will enclose the defined space, these flaps do not automatically interlock and bear against each other so as to provide a locked solid construction.

Accordingly, it is an object of the present invention to provide an automatically deployable collapsible ornamental solid which has a particularly attractive shape.

It is another object of the present invention to provide an automatically deployable collapsible ornamental solid in the form of a collapsible polyhedron.

It is another object of the present invention to provide for such a collapsible ornamental solid which may be cut from a single continuous sheet of material.

It is another object of the present invention to provide for such an automatically deployable collapsible ornamental solid which will extend automatically from a flat folded condition to its expanded form as soon as the restraint holding it in a folded position is removed.

It another object of the present invention to provide for such a collapsible ornamental solid which will automatically deploy by means of an inexpensive elastic band.

It is another object of the present invention to provide an automatically deployable collapsible ornamental solid which is adapted to accept additional collapsible shapes to form a complex automatically deployable ornamental solid.

It is another object of the present invention to provide for a collapsible ornamental solid automatically that, when deployed, positively forms a hollow solid.

It is another object of the present invention to provide a collapsible ornamental solid adaptable for display of ornamental designs printed on the surface thereof.

It is another object of the present invention to provide a collapsible ornamental solid adaptable for the insertion of photographs and other informative cards into the interior of said solid and viewable through an aperture cut therein.

It is another object of the present invention to provide a collapsible ornamental solid that, through an aperture in said solid, displays a photograph or display card which is recessed from the solid's surface.

It is another object of the present invention to provide for a collapsible ornamental solid that provides for the above objects in a simple, clean, attractive and relatively inexpensive construction.

DESCRIPTION OF THE DRAWINGS

A more complete appreciation of the invention and many of the attentive features thereof will be readily apparent by reference to the following description when considered in connection with the accompanying drawings.

Figure 1:
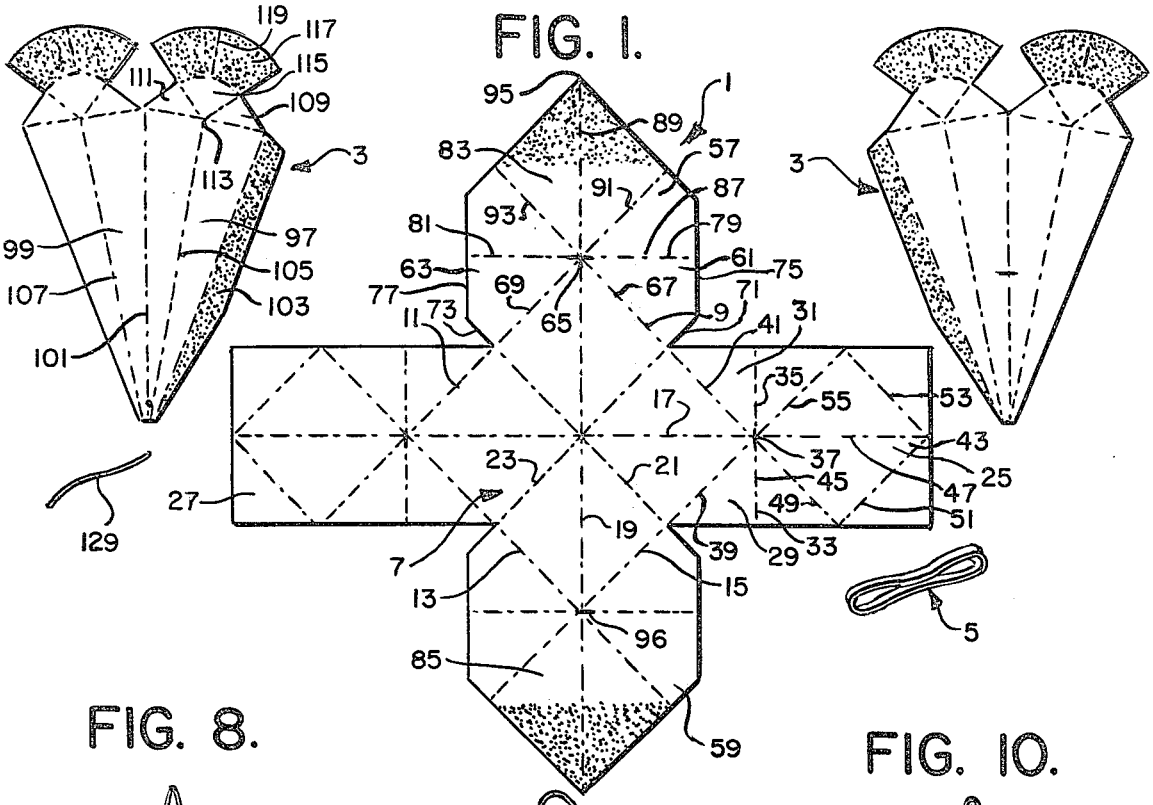
FIG. 1 is a plan view of the blank of the collapsible ornamental solid of the present invention after die cutting, scoring and glue application, but prior to folding and final bonding.

The present invention will be best understood from consideration of the following detailed description taken in connection with the above-described drawings. However, one skilled in the art will recognize that the invention is not confined to the embodiment and variations shown and described.

DESCRIPTION OF THE INVENTION

Referring now to the drawing in FIGS. 1–6 an embodiment of the present invention can be seen. For ease of understanding like reference numbers designate corresponding parts in the various embodiments disclosed in this specification.

Referring to FIG. 1 blank 1 of the collapsible ornamental solid is shown. Also seen are blanks for collapsible ornamental spires 3 and elastic band 5.

Blank 1 comprises a central square 7 having scores 9, 11, 13 and 15 defining its sides. Also, scores 17 and 19 are coincident with the diagonals of central square 7 and scores 21 and 23 are coincident with the medians of central square 7.

Blank 1 also comprises a first polygon 25 and a third polygon 27 diagonally opposite first polygon 25. Both first polygon 25 and third polygon 27 comprise first right triangles 29 and second right triangles 31. Right triangle 29 and 31 have colinear legs 33 and 35 terminating in a coincident vertices 37.

Each of first and second right triangles 29 and 31 also have a hypotenuses 39 and 41, which are hinged to adjacent sides of central square 7, i.e., sides 9 and 15, extending from vertex at the intersection of those two adjacent sides to the midpoint of those respective sides. Thus, vertices 37 of right triangles 29 and 31 are also coincident to the vertex at the intersection of the sides of central square 7 to which said right triangles are hinged.

Each of polygons 25 and 27 also include an outer square 43, having a first side 45 hinged to the colinear legs 33 and 35 of right triangles 29 and 31. Outer square 43 also has a score 47 coincident with its median perpendicular to said first side 45 and scores 49, 51, 53 and 55, each of which joins the midpoints of two adjacent sides of said outer square 43.

Blank 1 also comprises a second polygon 57 and a fourth polygon 59. Each of polygons 57 and 59 include a first quadilateral 61 and a second quadilateral 63.

Quadilaterals 61 and 63 have a common vertex 65. Vertex 65 is also coincident with the vertex of two of the adjacent sides of said central square 7. In the case of second polygon 57, vertex 65 is coincident with the vertex between adjacent sides 9 and 11 of central square 7.

Quadilaterals 61 and 63 have first sides 67 and 69, respectively, which sides extend from vertex 65 to the midpoint of the side of central square 7 to which said first sides are respectively hinged. Second sides 71 and 73 of first and second quadilaterals 61 and 63, respectively, are perpendicular to the sides of central square 7 and extend from the endpoint of first sides 67 and 69, respectively.

First and second quadilaterals 61 and 63 also have third sides 75 and 77, respectively. Third sides 75 and 77 extend from the endpoint of said second sides 71 and 73, respectively, to fourth sides 79 and 81. Fourth sides 79 and 81 are colinear, intersect common vertex 65 and are perpendicular to the diagonal of central square 7 which intersects the vertex of central square 7 which they intersect.

Second and fourth polygons 57 and 59 also include flaps 83 and 85, respectively. In this embodiment each of flaps 83 and 85 comprise a pentagon having a base 87 coincident with and hinged to fourth sides 79 and 81 of quadilaterals 61 and 53. Flaps 83 and 85 also have in this embodiment three scores 89, 91 and 93. Score 89 is coincident with the altitude of flaps 83 and 85 joining the midpoint of base 87 and the apogee 95 of flaps 83 and 85; and scores 91 and 93 are coincident with altitudes of flaps 83 and 85 joining the midpoints of base 87 and of the sides intersecting apogee 95.

Small slits 96 are cut perpendicular to the diagonals of central square 7 at the vertices of central square 7. As will become evident, these slits fix elastic band 5 in place.

Also shown in FIG. 1 is spire 3. Spire 3 comprises two isosoles triangles 97 and 99 hinged together along score 101 coincident with one leg of each of said triangles. Hinged to the remaining leg of isosoles triangle 97 is glue flap 103. Isosoles triangles 97 and 99 are bisected by scores 105 and 107, respectively.

Each of isosoles triangles 97 and 99 have a first wedge 109 and a second wedge 111 hinged to their base. Wedges 109 and 111 each have two legs terminating in a vertex 113, which is also common to the point of intersection of scores 105 and 107 with the bases of the respective isosoles triangles 99 and 101.

A third wedge 115 also has two legs, each of which is hinged to the leg of first wedge 109 and second wedge 111 that are not hinged to the bases of isosoles triangles 97 and 99.

Glue flap 117 is hinged to a remaining side of third wedge 15 and has a score 119 coincident with a line colinear with score 105 of isosoles triangles 97 and 99.

ASSEMBLY AND OPERATION OF FIGS. 1–6

Adhesive is placed on the surface of glue flaps 83 and 85 near the apogee of the pentagon, as shown by the stipling in FIG. 1. Similarly, adhesive is placed on glue flaps 117 and 103 of spires 3 as shown in FIG. 1.

To assemble blank 1 the following procedure may be used, although one skilled in the art will readily recognize that other procedures may be acceptable. Second polygon 57 is folded on the scores coincident with sides 67 and 69, fourth sides 79 and 81, and scores 91 and 93 so that first quadilateral 61 and second quadilateral 63 lie atop central square 7, and upon them rest the quadilateral formed between fourth side 79 and score 91 and fourth side 81 and score 93, respectively. When folded in accordance with this procedure apogee 95 is approximately coincident with the central point of central square 7.

Fourth polygon is folded similar to the second polygon. Accordingly, apogee 95 of fourth polygon 59 lies approximately adjacent to apogee 95 of second polygon 57.

First polygon 25 and third polygon 27 are folded similarly to polygons 57 and 59. That is, first polygon 25 is folded along the scores coincident with sides 9 and 11 and colinear legs 33 and 35, and scores 49 and 55. When thus folded, right triangles 29 and 31 lie atop of central square 7 and they in turn are covered by outer square 43. Third polygon 27 is folded similarly to first polygon 25.

Figure 1A:
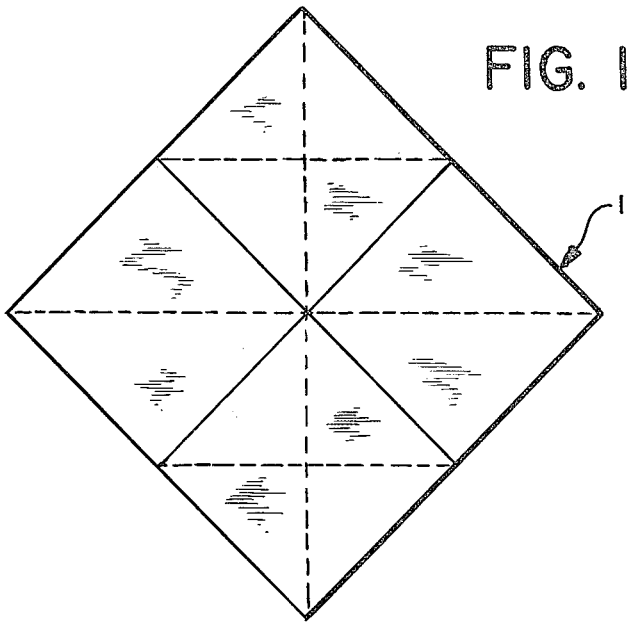
FIG. 1*a* is a plan view of the folded and bonded, but undeployed, collapsible ornamental solid of FIG. 1.

The triangles of first polygon 25 and third polygon 27 defined between the edges of said polygons and scores 51 and 53 are bonded to the surfaces of flaps 83 and 85, e.g., scores 51 and 53 lie adjacent to the sides of polygons 57 and 59, intersecting apogee 95. When folded in this manner blank 1 resembles the construction depicted in FIG. 1*a*.

Elastic band 5 is then stretched around the circumference of folded blank 1 so as to engage slits 96 located at the vertices of central square 7.

As one skilled in the art will recognize as long as pressure is maintained upon and approximately perpendicular to the flat surfaces of blank 1, it will remain in a relatively flat configuration. However, when such pressure is relieved, the force created by elastic band 5 will cause the collapsible ornamental solid of the present invention to deploy and resemble the solid shown in FIGS. 2 through 6, absent spires 3.

As recognized from the drawings when deployed the collapsible ornamental solid of the present invention totally encloses the space that it defines. The features of the present invention that insure total enclosure are found principally in second polygon 57 and fourth polygon 59. Unlike first polygon 25 and third polygon 27 third sides 75 and 77 of polygons 57 and 59, if extended, would not intersect the midpoint of the side of central square 7, but would intersect the side of central square 7 so as to enclose more than one-half of the side of central square 7 in the polygon. The surfaces of polygons 57 and 59 deploy preferably under the surfaces of polygons 25 and 27 and thus, when deployed, because of the extra width of polygons 57 and 59, the surfaces of polygons 57 and 59 extend below those of polygons 25 and 27. Also, the surfaces of adjacent polygons tend to bear against each other, positively locking the fully deployed collapsible ornamental solid.

Spires 3 are folded in the following preferred manner. That is, adhesive is placed upon glue flaps 103 and 117. Glue flap 103 is then folded along the hinge joining it to the adjacent isosoles triangle 97 so as to have glue flap 103 lie atop isosoles triangle 97 with the glue facing outwardly. Isosoles triangle 99 is then folded along score 101 so that its surface engages the glue upon glue flap 103 and bonds thereto.

Spires 3 then may be attached to the folded blank 1 by bonding glue flaps 117 with the outer surfaces of folded blank 1 so that score 119 is coincident with scores which are coincident with the diagonals of central square 7 (e.g., scores 19).

If spires 3 are attached to one or more apogees 95 in the foregoing manner, when the restraining pressure is relieved from the surfaces of folded blank 1, both blank 1 and the annexed spires 3 will automatically deploy as shown in FIGS. 2, 3, 5 and 6.

Figure 4:
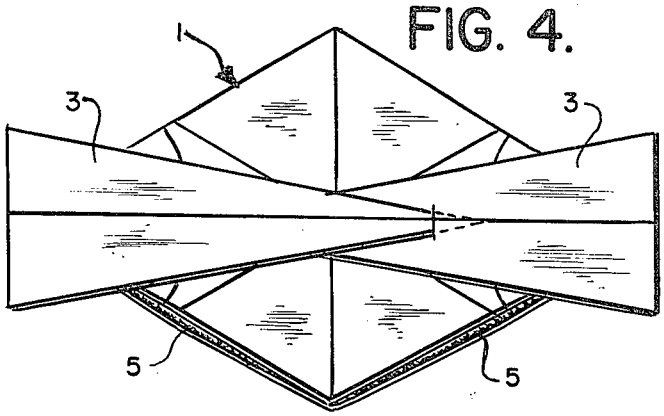
FIG. 4 is a plan elevational view of the fully assembled, but collapsed, collapsible ornamental solid of FIG. 1.
Figure 2:
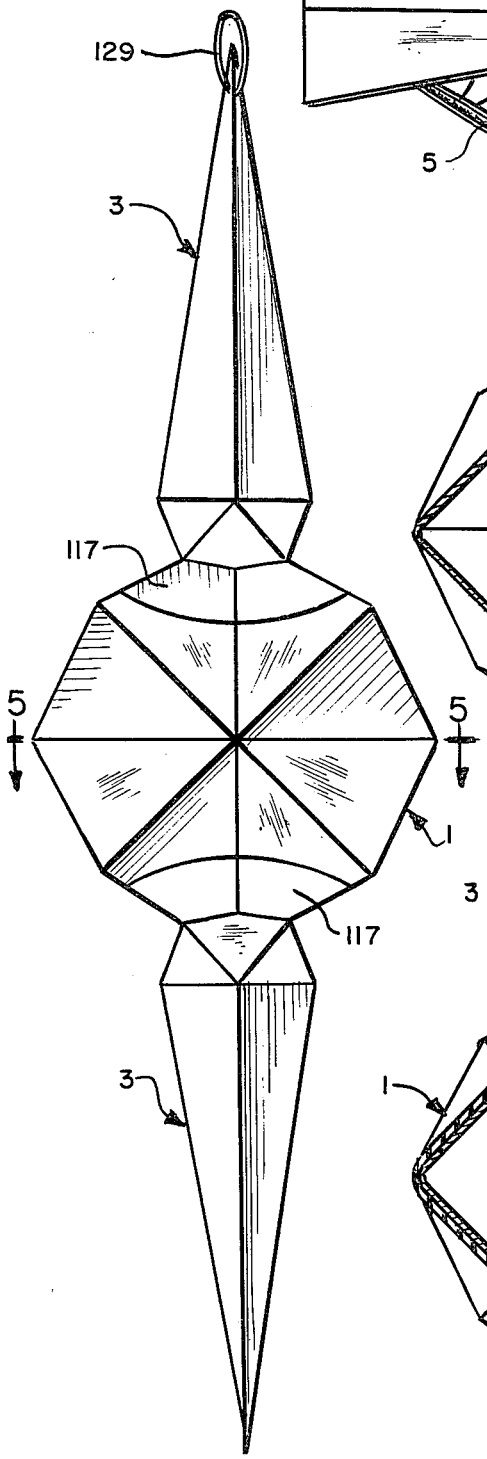
FIG. 2 is a front elevational view of the fully deployed collapsible ornamental solid of FIG. 1.
Figure 3:
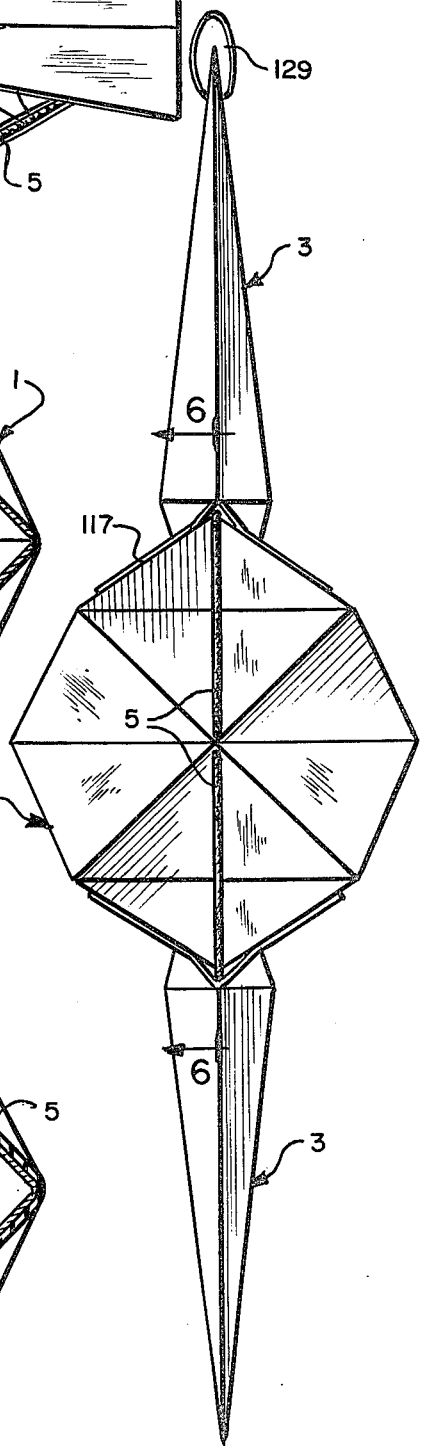
FIG. 3 is a side elevational view of the fully deployed collapsible ornamental solid of FIG. 1.
Figure 5:
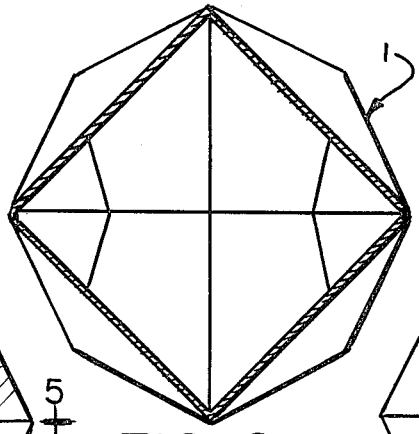
FIG. 5 is a cross-sectional view along line 5—5 of FIG. 2 of the fully deployed collapsible ornamental solid.
Figure 6:
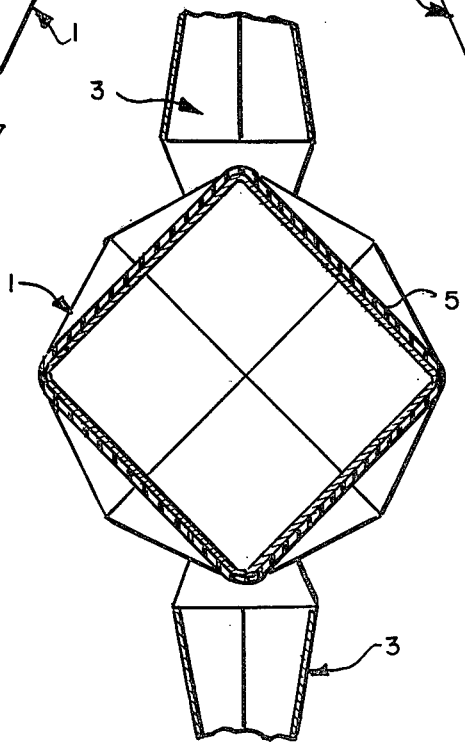
FIG. 6 is a cross-sectional view along line 6—6 of FIG. 3 of the fully deployed collapsible ornamental solid.

FIG. 4 shows a fully assembled, folded and bonded, but collapsed, ornamental solid, including spires 3. In this figure spires 3 are folded along the scores coincident with the base of isosoles triangles 99 and 101 to fold them against the collapsed and assembled blank 1. In this configuration the collapsible ornamental solid of the present invention is quite compact, yet will automatically deploy as shown in the other figures, when the restraining pressure holding it in that collapsed state is removed.

As one skilled in the art will recognize, the restraining pressure referred to above may be supplied by any means, for example, an ordinary envelope in which the collapsed ornamental solid is placed. If an envelope is used, it may serve the function of not only restraining the collapsible ornamental solid from deploying, but also utilitarian means for packaging and transmitting the collapsible ornamental solid.

DESCRIPTION OF FIGS. 7–11

As already noted one skilled in the art will immediately recognize variations of the basic invention shown in the above-described embodiment. Another embodiment is shown in FIGS. 7–11. Referring to the blank illustrated in FIG. 7 and comparing it to the blank illustrated in FIG. 1, the differences between this embodiment and the above-described embodiment are clear. In the following description only these differences are highlighted. Furthermore, in accordance with the general scheme of this specification like reference numerals are utilized to connote like parts in each of the figures.

Figure 7:
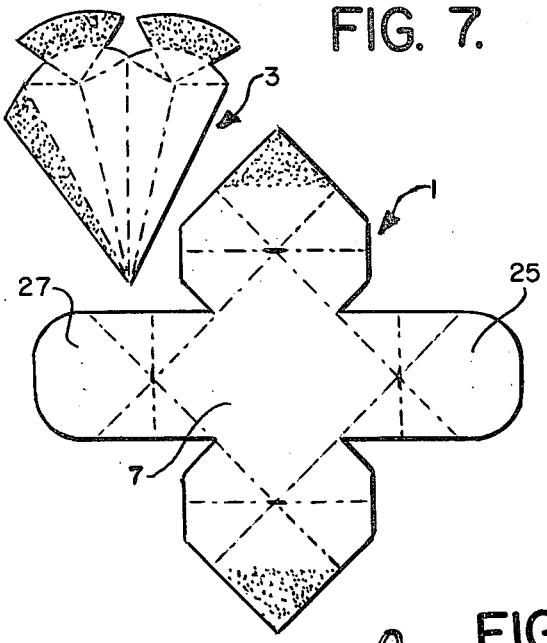
FIG. 7 is a plan view of a blank of another embodiment of the present invention after cutting, scoring and glue application, but prior to folding and bonding.

The principal differences between the embodiments of FIG. 7 and FIG. 1 are that in the embodiment of FIG. 7 the scores coincident with the diagonals of central square 7 are omitted, as are scores 51 and 53 of first polygon 25 and third polygon 27. The outer corners of first polygon 25 and third polygon 27 have been rounded. It can be noted that the non-leg side of third wedge 115 is rounded.

OPERATION OF THE EMBODIMENT OF FIGS. 7–11

The embodiment of the present invention shown in FIG. 7 is folded similarly to that of the embodiment shown in FIG. 1. Furthermore, the elastic band 5 and spires 3 are similarly attached. If desired, instead of bonding polygons 25 and 27 under polygons 57 and 58, they could be bonded on top. The rounded corners of polygons 25 and 27 would then be visible and more attractive than if they had not been rounded, but left square as in the embodiment of FIGS. 1–6.

When fully deployed, the absence of the scores coincident with the diagonals and medians of central square 7 and scores 51 and 53 of polygons 25 and 27 causes the deployed ornamental solid to have flat faces, rather than coming to a vertex as did the embodiments of FIGS. 1–6. One skilled in the art could devise many utilitary purposes for these flat faces. For example, as shown in FIGS. 8 and 9, these flat faces could be used for the printing or attachment of ornamental or informative designs or messages.

Figure 8:
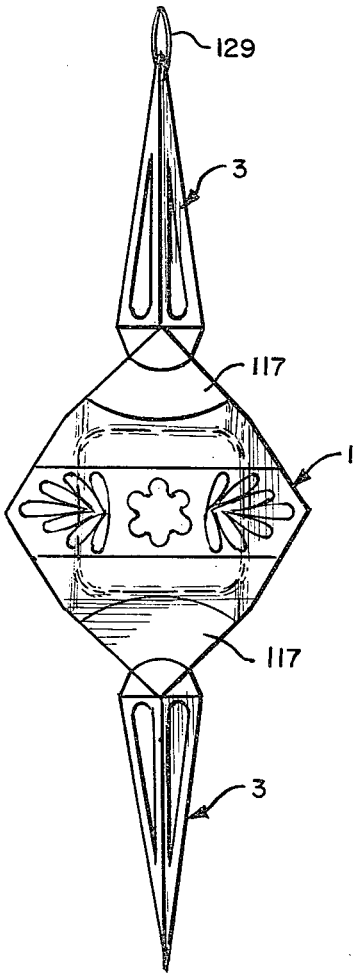
FIG. 8 is a front elevational view of the fully deployed embodiment of the present invention shown in FIG. 7 with an imprinted decorative design.
Figure 9:
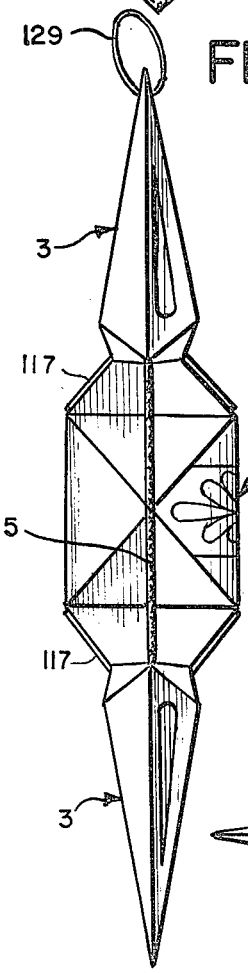
FIG. 9 is a side elevational view of the fully deployed embodiment of the present invention shown in FIG. 7.
Figure 10:
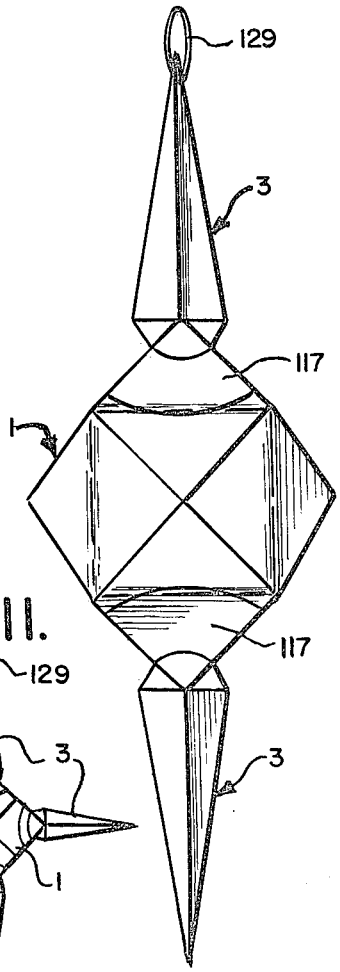
FIG. 10 is a rear elevational view of the fully deployed embodiment of the present invention shown in FIG. 7 collapsed.
Figure 11:
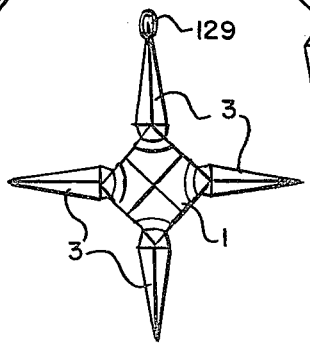
FIG. 11 is a front elevational view of the fully deployed embodiment of the present invention shown in FIG. 7 with four collapsible ornamental solids.

Like the embodiments illustrated in FIGS. 1–6, the embodiment illustrated in FIGS. 8–10 uses two spires 3. However, one skilled in the art could easily add more spires, as in FIG. 11 where four spires are illustrated.

DESCRIPTION AND OPERATION OF FIGS. 12–17

Figure 12:
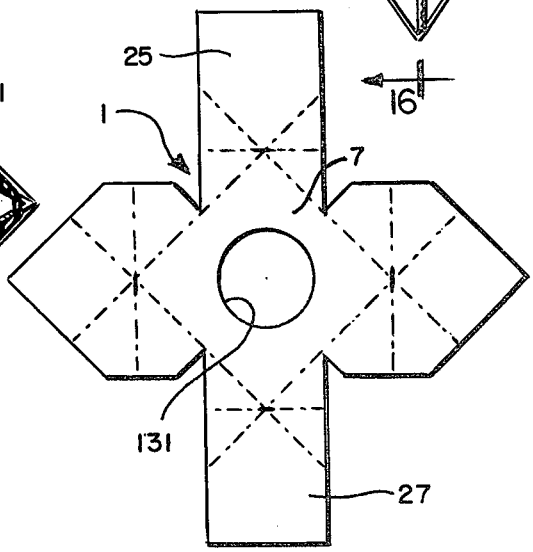
FIG. 12 is a plan view of a blank of another embodiment of the present invention adapted for ornamental display of photographs and other inserts.

As with the embodiment described immediately above the differences between the embodiment illustrated in FIGS. 12 through 17 can readily be discerned by comparing the blank shown in FIG. 12 with the blanks shown in FIGS. 1 and 7. This comparison reveals that, similar to the blank in FIG. 7, the blank of FIG. 12 does not have scores in central square 7 and on the exterior ends of first polygon 25 and third polygon 27. Furthermore, the central portion of central square 7 has been removed creating a circular aperture 131. Another obvious difference in the embodiment of FIGS. 12–17 is the absence of adhesive. Rather, in this embodiment, the various polygons are affixed to each other by means of tape, which is clearly shown in FIG. 14 as tape 133.

Figure 13:
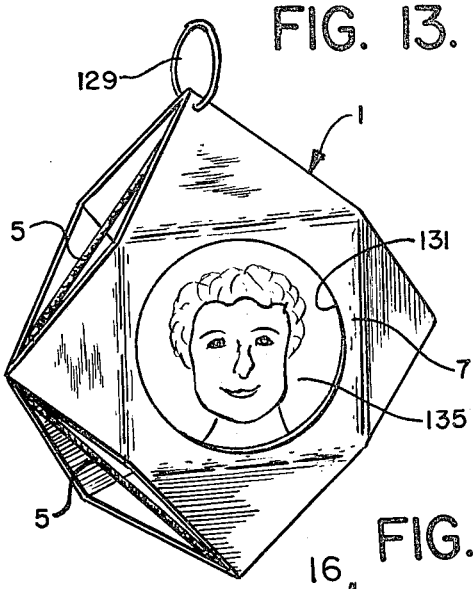
FIG. 13 is a perspective elevational view of the fully deployed embodiment of the present invention shown in FIG. 12.
Figure 14:
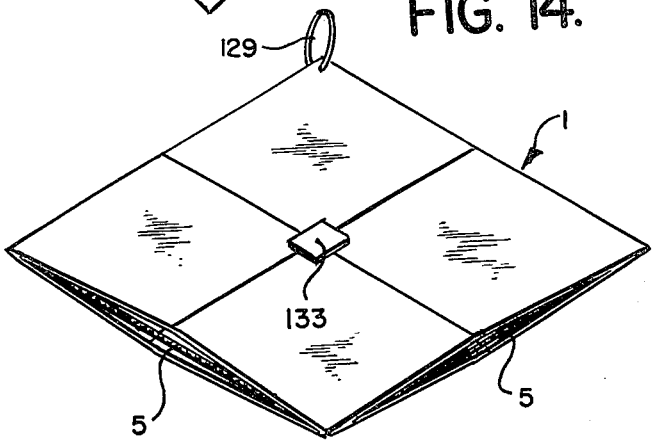
FIG. 14 is a perspective elevational view of the reverse side of the embodiment of the present invention shown in FIG. 12.
Figure 15:
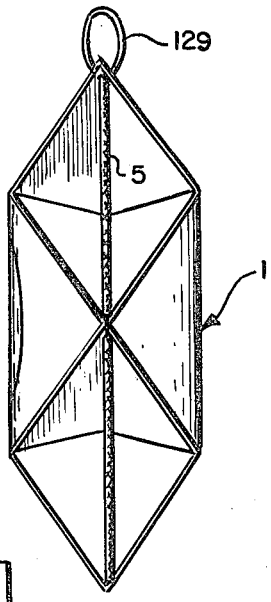
FIG. 15 is a side elevational view of the fully deployed embodiment of the present invention shown in FIG. 12.
Figure 16:
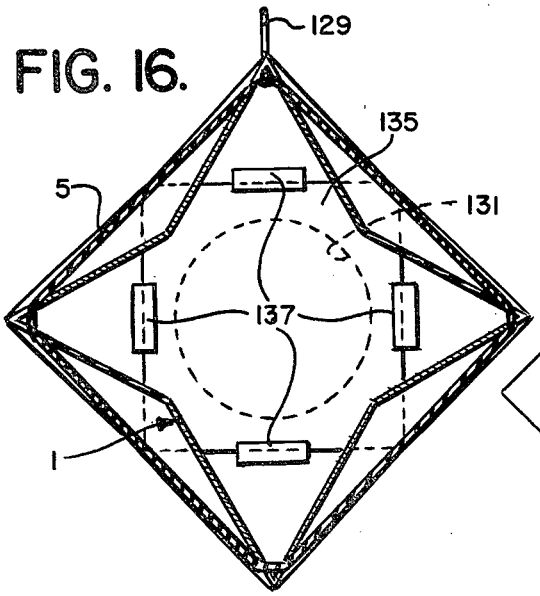
FIG. 16 is a cross-sectional view along line 16—16 of the fully deployed embodiment of the present invention shown in FIG. 12.

As most clearly shown in FIGS. 13 and 16, a photograph 135 is affixed behind aperture 131. Of course, a display card or other insert could be substituted. In the preferred embodiment the photograph is affixed by means of tapes 137. Use of such tapes, rather than glue, permits the photograph to move relative to the surface of the face of central square 7, creating the attractive effect of recessing into the fully deployed collapsible ornamental solid.

Figure 17:
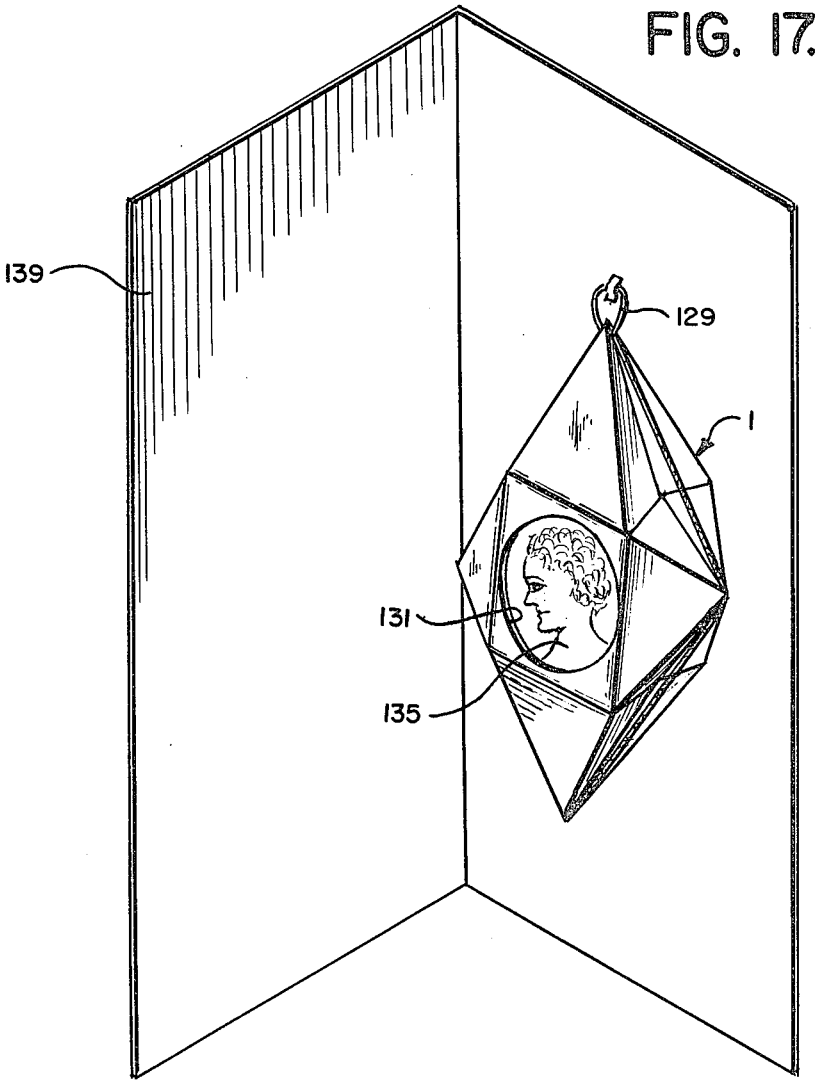
FIG. 17 is a perspective view of another fully deployed embodiment of the present invention wherein the collapsible ornamental solid is mounted on a display card.

Like the prior embodiments, this embodiment is automatically deployed by elastic band 5 when the pressure restraining it in a collapsed state is removed. FIG. 17 illustrates one utilitarian variation to apply the restraining pressure. In this application the collapsed ornamental solid is hung by cord 129 from the interior wall of folded card 139. When closed and placed in a suitable envelope, card 139 will exert pressure causing the collapsible ornamental solid to collapse and remain in a relatively flat condition. After the card's recipient opens the envelope and removes the card, the collapsible ornamental solid will immediately deploy, providing an attractive and utilitarian frame and easel for the photograph or drawing placed behind aperture 131. Furthermore, various printed salutations could be embossed upon card 139. The card and the attached deployed collapsible ornamental solid could be displayed by placing the card on a mantel or table, or in the alternative, the deployed collapsible ornamental solid could be removed from the card and suspended from a Christmas tree or other convenient object.

While the invention has been described by specific embodiments in illustrated variations, it is not limited thereto. Obvious modifications will occur to those skilled in the art. For example, various other methods of fastening the collapsible ornamental solid to cards or other means of displaying it or providing means to insure that the collapsible ornamental solid remains in a relatively flat collapsed state, will immediately come to mind. Furthermore, various modifications could be made through the basic design of the blanks described above without departing from the spirit of the invention. For example, the width of second and fourth polygons 57 and 59 could be extended or could be narrowed. Thus, one skilled in the art could create various modifications without departing from the scope of this invention as defined by the following claims:

What is claimed is:

1. A collapsible polyhedron constructed from a single blank comprising:

a central square;

first and third polygons diagonally opposite each other, each comprising:

first and second congruent right triangles having colinear legs with a coincident vertex, said coincident vertices also coincident with a vertex of said central square, and having hypotenuses hinged to the side of said central square;

an outer square, first and second creases joining a first side of said outer space to the colinear legs of said first and second triangles, a second crease coincident with the median of said outer square perpendicular to said first side, and third and fourth creases, each of which joins the midpoint of said first side with a midpoint of an adjacent side;

second and fourth polygons diagonally opposite each other, each comprising:

first and second quadrilaterals having a coincident vertex, said coincident vertex also coincident to a vertex of said central square, first sides hinged to consecutive sides, respectively, of said central square and having their endpoints coincident with midpoints of said central square, second sides perpendicular to sides of said central square and joined to the endpoint of said first side, third sides joined to the endpoint of said second side and parallel to the diagonal of said central square that intersects said coincident vertex, and a fourth side perpendicular to said third side and joined to the endpoint of said third side and to the coincident vertex; and a pentagon having a base hinged to the fourth side of said quadrilaterals and having a crease coincident with the altitude joining the midpoint of said base and said pentagon's apogee and creases coincident with the altitudes from the midpoint of said base to the sides of said pentagon intersecting the apogee.

2. A collapsible polyhedron as in claim 1 wherein each of said first, second, third and fourth polygons have a slit intersecting the vertex of said polygons coincident with a vertex of said central square and perpendicular to the diagonal of said central square that intersects said coincident vertex.

3. A collapsible polyhedron as in claim 2 wherein the triangular area in the outer square of said first and second polygons defined by the side of said outer square opposite said first side and the adjacent side and the respective one of said third through fifth creases coplineary joined to the triangular section of said pentagon in said first and third polygons formed between the pentagon altitude and the creased joining the base and the sides intersecting the pentagon's apogee.

4. A collapsible polyhedron as in claim 3 including a slit at each vertex of said central square substantially perpendicular to the diagonal of said central square intersecting that vertex.

5. A collapsible polyhedron as in claim 4 including a continuous elastic band extending from slit to slit.

6. A collapsible polyhedron as in claim 1 including:

an aperture in said central square.

7. A collapsible polyhedron as in claim 6 including:

a card;

tape affixing said card to the exterior surface of said central square behind said aperture.

8. A collapsible polyhedron as in claim 1 wherein said central square has scores colinear with its medians and diagonals.

9. A collapsible polyhedron as in claim 1 wherein said central square has printing on its exterior surface.

10. A collapsible polyhedron as in claim 1 wherein said central square has creases colinear with its diagonals and medians and said outer square has fifth and sixth creases, each of which joins the midpoint of the side of said outer square opposite said first side with the midpoint of adjacent side.

11. A collapsible polyhedron as in claim 1 including a collapsible spire affixed to a vertex of said central square comprising:

two isosoles triangles hinged together along one leg and each having a crease colinear with its altitude;

a glue flap hinged to a leg of one of said isosoles triangles; and each of said isosoles triangles having first and second wedges, each having at least two intersecting legs terminating in a vertex, said vertex of each of said wedges coincident to each other and to the point where the crease of said isosoles triangles intersects the base of said isosoles triangle, and having one of said legs of each wedge hinged to the base of said isosoles triangle;

a third wedge, having at least two legs and a third side, said two legs hinged to the non-colinear legs of said first and second wedges;

a glue flap hinged to the side of said wedge and having a crease colinear with the crease in the said isosoles triangle.

12. A collapsible polyhedron as in claim 1 including:

a display means comprising at least two leaves, each of which has greater area than said collapsible polyhedron;

suspension means to suspend said collapsible polyhedron from one of said leaves.

13. A collapsible polyhedron as in claim 12 wherein said suspension means is affixed to one of the vertexes of said central square and said display means comprises a single continuous sheet folded substantially in half to form two leaves between which is disposed said collapsible polyhedron.

14. A collapsible ornamental solid comprising two intersecting longitudinal strips, each of said strips including creases defining at least four squares colinear along one of their diagonals, the middle two of said squares in each of said two intersecting strips defining a central square having creases coincident with its sides, its diagonals, and its medians.

15. A collapsible hollow solid constructed from a single blank comprising:

a first strip;

a second strip perpendicular to said first strip;

said first and second strips having scores defined by the sides of a plurality of quadrilaterals wherein the diagonals of said quadrilaterals are colinear and the vertices of adjacent quadrilaterals are coincident.

16. The collapsible hollow solid of claim 15 including scores defined by said diagonals.

17. The collapsible hollow solid of claim 16 wherein said first and second strips have scores perpendicular to said diagonals and intersecting said coincident vertices.

* * * * *